US010052906B2

(12) United States Patent
Cheon

(10) Patent No.: US 10,052,906 B2
(45) Date of Patent: Aug. 21, 2018

(54) MULTICOLOR WRITING INSTRUMENT WITH AUTOMATIC RETURN FUNCTION

(71) Applicant: Kwang Ju Cheon, Kyunggi-do (KR)

(72) Inventor: Kwang Ju Cheon, Kyunggi-do (KR)

( * ) Notice: Subject to any disclaimer, the term of this patent is extended or adjusted under 35 U.S.C. 154(b) by 97 days.

(21) Appl. No.: 15/411,308

(22) Filed: Jan. 20, 2017

(65) Prior Publication Data

US 2017/0246903 A1 Aug. 31, 2017

(30) Foreign Application Priority Data

Feb. 25, 2016 (KR) ..... 10-2016-0022455

(51) Int. Cl.

| | |
|---|---|
| ***B43K 27/04*** | (2006.01) |
| ***B43K 24/12*** | (2006.01) |
| ***B43K 24/10*** | (2006.01) |
| ***B43K 25/02*** | (2006.01) |
| ***B43K 27/12*** | (2006.01) |

(52) U.S. Cl.

CPC ..... *B43K 24/12* (2013.01); *B43K 24/10* (2013.01); *B43K 25/028* (2013.01); *B43K 27/12* (2013.01)

(58) Field of Classification Search

CPC ..... B43K 24/12; B43K 24/10
USPC ..... 401/31, 33
See application file for complete search history.

(56) References Cited

U.S. PATENT DOCUMENTS 2,781,741 A * 2/1957 Tintner ..... B43K 24/10 401/194
3,260,242 A * 7/1966 Liguori ..... B43K 24/10 401/29
6,939,069 B2 * 9/2005 Odaka ..... B43K 24/146 401/30

FOREIGN PATENT DOCUMENTS

JP 2005111876 4/2005
KR 20110055491 5/2011

* cited by examiner

*Primary Examiner* — Jennifer C Chiang
(74) *Attorney, Agent, or Firm* — IPLA P.A.; James E. Bame

(57) ABSTRACT

A multicolor writing instrument with an automatic return function includes a lower housing having a hollow cylindrical shape; an upper housing connected to an upper portion of the lower housing and formed with locking steps; a clip member hingedly provided on the upper housing so as to be movable about a hinge shaft; a coil spring resiliently installed between the clip member and the upper housing; pen cores filled with at least two different color inks; knobs having ends fitted into the respective pen cores; return springs resiliently installed between the pen cores and the knobs; and a return member formed integrally with the clip member on one side of the hinge shaft and toward the respective knobs.

1 Claim, 11 Drawing Sheets

MULTICOLOR WRITING INSTRUMENT WITH AUTOMATIC RETURN FUNCTION

BACKGROUND

The present invention relates to a multicolor writing instrument with an automatic return function, and more particularly, to a multicolor writing instrument that is more simply configured to cause an exposed nib of one of pen cores of the writing instrument to be automatically accommodated in a pen housing of the writing instrument when the writing instrument is put on clothes using a clip, thereby preventing the nib of pen core of the writing instrument and the clothes from being damaged when the writing instrument is not in use.

In general, each of pens for various purposes, including ballpoint pens, is comprised of a pen core and a spring in a housing, a knob and the like such that a nib of the pen core may be exposed to the outside while lifting or lowering the pen core in the housing.

In addition to such a monochrome pen, a multicolor writing instrument simultaneously having pen cores for various colors in a single housing has been widely used in recent years.

In order to expose a nib of one of a plurality of pen cores for different colors in the multicolor writing instrument, a knob is used to cause a nib of a pen core for a color desired by a user to be extracted in a slide manner when the user wants to take notes, thereby enabling writing.

The multicolor writing instrument is equipped with a plurality of pen cores 50 and springs for providing elastic forces required when the pen cores 50 are projected and retracted, in a limited space of a housing. An upper housing of a main body of the multicolor writing instrument is provided with respective knobs 60 connected to the pen cores 50 filled with multiple inks.

Each of the knobs 60 is slid under guidance of a relevant one of guide holes 21 of the upper housing 20 in a state where the knob is moved and locked, or released and returned. Upon movement of a selected pen core 50, a nib placed at a tip of the pen core is exposed to the outside of the writing instrument.

For example, a case where a user wants to use a pen core for blue will be described by way of example. In this case, the user downwardly slides a manipulation portion of a blue knob 60 connected to the pen core 50 for blue. Then, as a return spring 70 is compressed, the selected knob 60 and the pen core 50 are moved forward within the housing.

The knob 60 is slidably moved under the guidance of a relevant one of the guide holes 21 formed in a longitudinal direction of the upper housing 20 according to the orientations and number of the pen cores 50. At this time, the knob 60 moves downwardly and also slightly inwardly in the guide hole 21, and a top locking protrusion 61 formed at an uppermost portion of the knob is caught by locking steps 22 formed in the approximately middle of and inside the guide hole 21, so that a nib of the pen core 50 protrudes to the outside and thus a blue ballpoint pen is ready for writing.

Even when the user wants to use a pen core for another color, the writing instrument will be operated in the same manner as above. For example, when the user wants to use a pen core 50 for red in this state, a red knob 60 exposed to the outside of the upper housing 20 is pressed and moved downwardly and a lower unlocking portion 63 of inwardly protruding upper and lower unlocking portions 62 and 63 of the red knob is then brought into contact with and presses an upper unlocking portion 62 of the blue knob 60.

Therefore, the top locking protrusion 61 of the blue knob 60 which has been caught by the locking steps 22 is released, so that the blue knob 60 is returned to its original position by an elastic force of the return spring 70 which has been compressed. As the user further moves the red knob 60, a top locking protrusion 61 of the red knob 60 is caught by locking steps 22 formed in the approximately middle of and inside a relevant one of the guide holes 21, so that a nib of the pen core 50 for red protrudes to the outside and thus a red ballpoint pen is ready for writing.

In this manner, pen cores for two to five colors such as blue, red, black and the like are accommodated in a single pen housing, and the respective pen cores for desired colors can be selectively used as a multicolor writing instrument.

In order to cause a nib of a pen core, which has been exposed to the outside, to be accommodated in the housing while this multicolor writing instrument is stored or carried by a user, any of the other knobs 60 other than a knob corresponding to a pen core which has been already projected is manipulated to be moved to such an extent that a top locking protrusion 61 of the caught knob can be released from locking steps 22 and then the caught knob is returned to its original position, whereby all of the pen cores 50 and the knobs 60 return to a state before use of the multicolor writing instrument.

However, a conventional multicolor writing instrument has problems in that, for example, when it is put on a pocket of clothes or the like using a clip in a state where any of the nibs of the pen cores 50 is exposed to the outside of the housing, the exposed nib of the pen core 50 is damaged or the clothes are damaged by an ink due to contact of a nib of the pen core with the clothes for a long period of time, thereby often causing obstinate situations for users of the multicolor writing instrument.

SUMMARY OF THE INVENTION

An object of the present invention is to provide a multicolor writing instrument configured such that all pen cores can be automatically returned to the interior of a housing when the multicolor writing instrument is put on clothes, only with an additional simple structure and without increasing costs.

Another object of the present invention is to provide a multicolor writing instrument configured to prevent a case where an exposed nib of a pen core may be damaged or clothes may be stained by an ink when the multicolor writing instrument is put on the clothes, thereby improving reliability of the product.

To achieve the objects, the present invention provides a multicolor writing instrument with an automatic return function, including a lower housing 10 having a hollow cylindrical shape and having a nib passing through-hole 11 formed therethrough at a tip of the lower housing; an upper housing 20 connected to an upper portion of the lower housing 10 and having guide holes 21 and locking steps 22 formed respectively inside the guide holes; a clip member 30 hingedly provided on the upper housing 20 so as to be movable about a hinge shaft 31; a coil spring 40 resiliently installed between the clip member 30 and the upper housing 20; pen cores 50 accommodated in the upper housing 20 and the lower housing 10 and filled with at least two different color inks; knobs 60 installed to be slidably moved under guidance of the guide holes 21 and having ends fitted into the respective pen cores 50, wherein each of the knobs has a top locking protrusion 61 caught by the locking steps 22 and two unlocking portions 62 and 63; return springs 70 resiliently installed between the pen cores 50 and the knobs 60; and a return member 80 formed integrally with the clip member 30 on one side of the hinge shaft 31 and toward the respective knobs 60 so that when a lower end of the clip member 30 is pivoted, the return member 80 returns the respective knobs 60 and pen cores 50, wherein an auxiliary member 90 is further provided between the return member 80 and the knobs 60 so as to simultaneously press the knobs 60 when the return member 80 is pivoted in an upper space of the upper housing 20, and wherein the auxiliary member 90 has a guide groove 92 formed between posts 91 so that the auxiliary member may be operated with the return member 80 fitted into the guide groove, and the posts 91 are formed with guide channels 93 to guide a vertical movement of the auxiliary member within the upper housing 20.

DETAILED DESCRIPTION OF THE INVENTION

Figure 1:
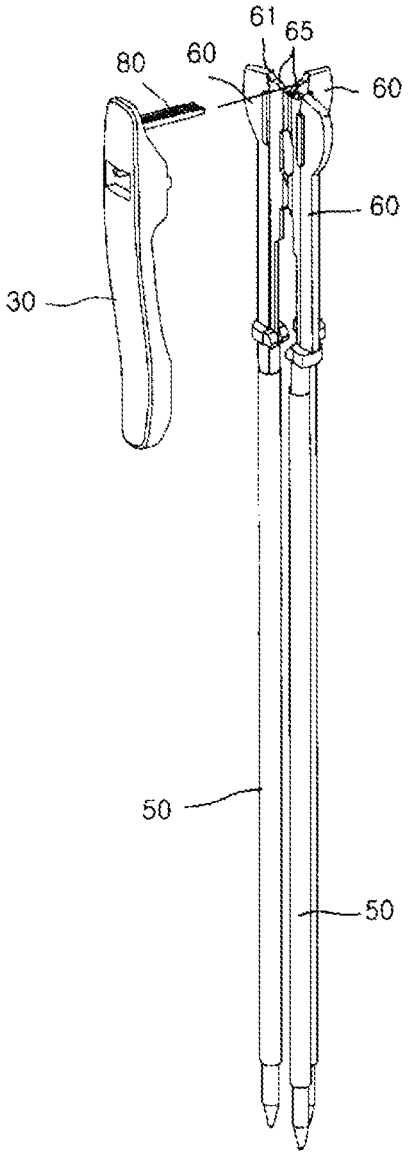
FIG. 1 is a perspective view showing a disassembled clip member in a state where knobs of a multicolor writing instrument according to the present invention are assembled.
Figure 2:
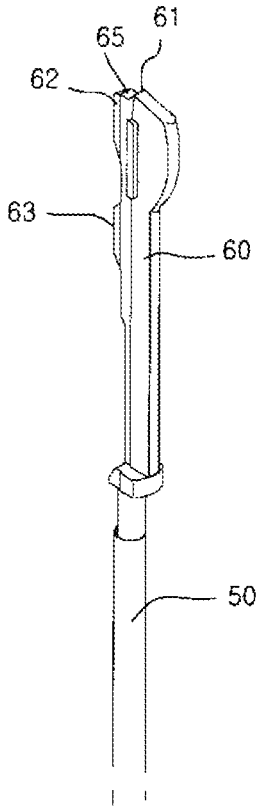
FIG. 2 is a perspective view showing one of the knobs of the multicolor writing instrument according to the present invention.
Figure 3:
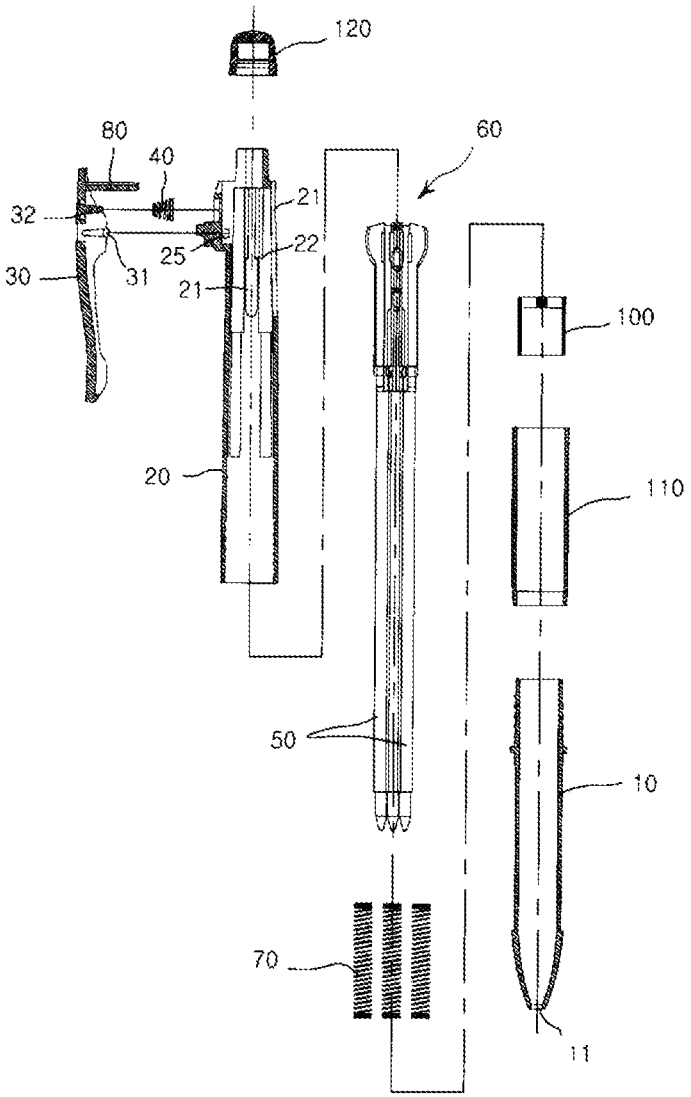
FIG. 3 is an exploded sectional view showing main portions of the multicolor writing instrument according to the present invention.
Figure 4:
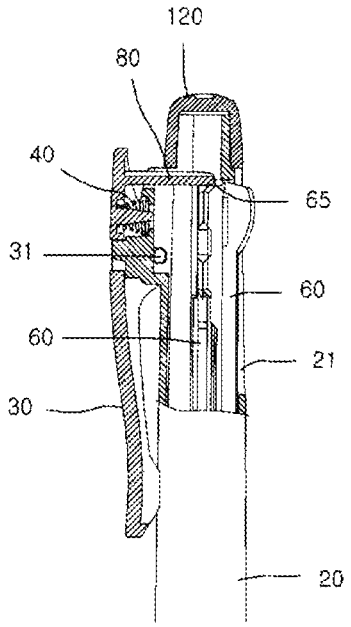
FIG. 4 is a sectional view showing assembled main portions in a stored state where the knobs and pen cores are not pressed in the multicolor writing instrument according to the present invention.

Hereinafter, preferred embodiments of the present invention will be described in detail with reference to the accompanying drawings.

For the sake of convenience of description, a multicolor writing instrument with an automatic return function according to the present invention will be described by way of example as having pen cores 50 for three colors of black, red, and blue.

The multicolor writing instrument with the automatic return function according to the present invention will be described based on a configuration in which the pen cores 50 for the three colors of black, red and blue are accommodated in upper and lower housings 20 and 10 and a pen core for a desired color is caused to be projected or retracted by manipulating a relevant one of knobs 60, as shown in the figures.

By pushing one of the knobs 60, a nib of a pen core for a desired color corresponding to the pushed knob is exposed to the outside so that the multicolor writing instrument can be ready for writing. By manipulating a knob 60 corresponding to another pen core other than the pen core of which the nib is exposed, it is possible to achieve switching to one of pen cores for other colors or accommodation of all the pen cores 50 into the housing.

The lower housing 10 has a hollow cylindrical shape and has a nib passing through-hole 11 formed therethrough at a tip of the lower housing so that a nib of each of the pen cores 50 can be moved outward from the interior of the housing.

The upper housing 20 is connected to an upper portion of the lower housing 10, primarily in a threadly engaged manner, and can accommodate the pen cores 50, return springs 70, a divider 100 and the like in an accommodation space defined therein.

Elongated guide holes 21 are formed along a periphery of the upper housing 20 in a longitudinal direction of the upper housing 20 in consideration of the number of the pen cores 50. Each of the guide holes 21 has locking steps 22 formed in the middle of and inside the guide hole, so that one of the knobs 60 to be described later is caught by the locking steps when the knob has been moved forward, thereby enabling writing in a state where the nib of the pen core is exposed.

The upper housing 20 is provided with a coupling groove 25, and a hinge shaft 31 of a clip member 30 is assembled in the coupling groove 25.

Therefore, the clip member 30 is installed to be movable about the hinge shaft 31, and a support shaft 32 is formed integrally with the clip member to prevent escape of a coil spring 40 installed to keep resiliency of the clip member.

When the multicolor writing instrument is put on a pocket of clothes, the clip member 30 serves to allow the multicolor writing instrument to be resiliently put thereon and to prevent the multicolor writing instrument from escaping from the clothes The pen cores 50 are filled with at least two different color inks and thus enable writing through the nibs at tips of the pen cores.

The knobs 60 are operating bodies installed to be slidably moved under guidance of the guide holes 21 in a state where the operating bodies are connected to the pen cores in the longitudinal direction, so that writing may be made by selecting the respective pen cores 50 for relevant colors.

The knobs 60 are made of a synthetic resin material to have the same structure. An uppermost portion of each of the knobs 60 is formed with a top locking protrusion 61 so as to be caught by the locking steps 22 in the guide hole 21. Two unlocking portions 62 and 63 protrude laterally from a side of the knob at positions spaced apart from each other in the longitudinal direction.

Figure 5:
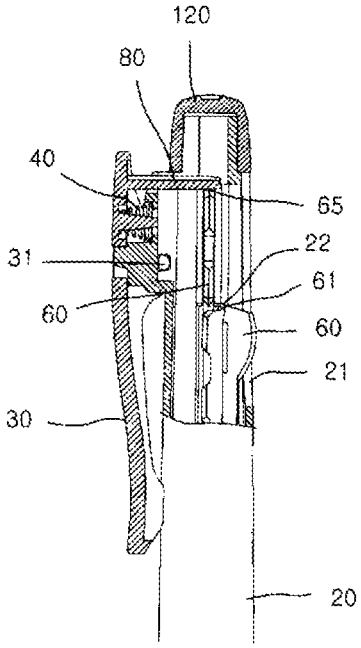
FIG. 5 is a sectional view showing the assembled main portions in a state where one knob and one pen core are moved forward for writing.

For example, when a user wants to use a pen core 50 for blue, a blue knob 60 that corresponds to the pen core for blue and is exposed outside the upper housing 20 is pressed and the knob 60 is moved under the guidance of the guide hole 21 until the top locking protrusion 61 at the uppermost portion of the knob 60 is caught by the locking steps 22, whereby the knob cannot be raised even by an elastic force of the return spring 70 and thus causes the writing instrument to be ready for writing (see FIG. 5).

Figure 9:
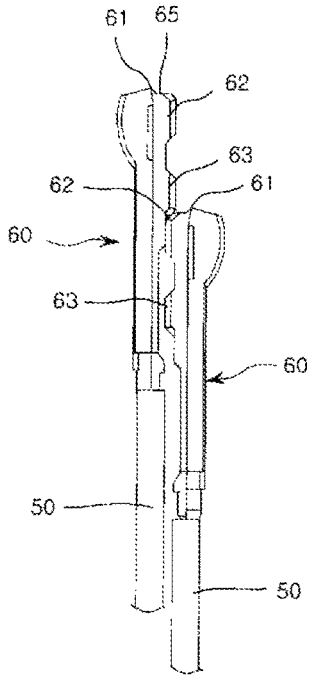
FIG. 9 is a front view showing a state where in order to return a knob that has been moved forward, a unlocking portion of another knob is brought into contact with the forward moved knob.

When the user wants to use a pen core 50 for red in this state and then presses a red knob 60 corresponding thereto, the red knob 60 is moved along the guide hole 21 so that a lower unlocking portion 63 of the red knob 60 is brought into contact with an upper unlocking portion 62 of two upper and lower unlocking portions 62 and 63 of the blue knob 60 while applying a force thereto in a direction approximately perpendicular to the advancing direction of the red knob 60 (see FIG. 9).

Therefore, the top locking protrusion 61 of the blue knob 60 that has been caught by the locking steps 22 is released and the blue knob 60 is then returned to its original position by the elastic force of the return spring 70 that has been compressed.

Subsequently, as the user further moves the red knob 60, the top locking protrusion 61 of the red knob 60 is caught by locking steps 22 formed in the approximately middle of and inside a relevant one of the guide holes 21, so that a nib of the pen core 50 for red protrudes to the outside and thus a red ballpoint pen is ready for writing.

In this manner, pen cores for multiple colors such as blue, red, black and the like are accommodated in a single pen housing, and the respective pen cores for desired colors can be selectively used as a multicolor writing instrument.

Moreover, when any of the other knobs 60 other than a knob corresponding to a pen core 50 which has been already projected is manipulated to be moved to such an extent that a top locking protrusion 61 of the caught knob can be released from the locking steps 22 and then the caught knob is returned to its original position, all of the pen cores 50 and the knobs 60 return to a state before use of the multicolor writing instrument.

The divider 100 guides the movements of the pen cores 50 in a separated state within the upper housing 20.

A hollow cylindrical rubber pad 110 is assembled to be fitted over the lower housing 10 to improve a contact feeling when the user grips it to take notes.

A cap 120 is firmly assembled to the top of the upper housing 20 to elegantly finish an appearance of the upper housing 120 and to prevent intrusion of foreign substances into the upper housing. This configuration of the cap 120 is the same as that of a conventional one.

A most important constitutional feature of the present invention is to prevent damage to the nibs of the pen cores and clothes by causing the nibs of all the pen cores 50 to be automatically accommodated in the housing when the writing instrument is put on the clothes using the clip member 30.

That is, in the present invention, a return member 80 is formed integrally with the clip member 30 on one side of the hinge shaft 31 and toward a central portion where the respective knobs 60 are installed, so that when a lower end of the clip member 30 is pivoted, the return member 80 is also pivoted to return the respective knobs 60 and pen cores 50 to their initial states.

Figure 6:
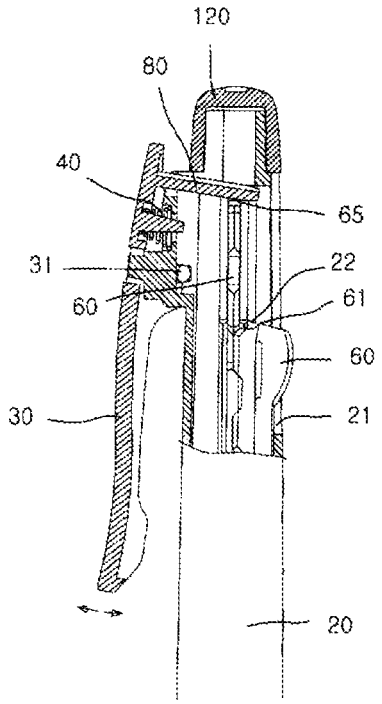
FIG. 6 is a sectional view showing the assembled main portions in a state where a clip member is pivoted to press another knob in order to put the writing instrument of the present invention on clothes.
Figure 7:
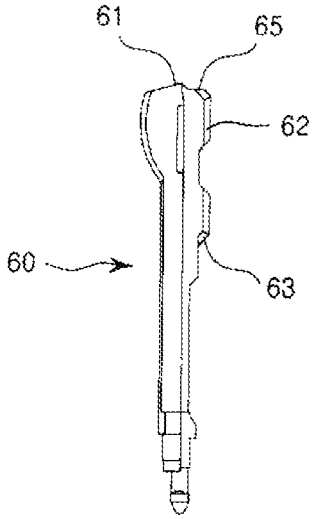
FIG. 7 is a front view showing a configuration of the knob.

When the lower end of the clip member 30 is intentionally spread during a process of putting the writing instrument on a pocket of clothes by the user, the return member 80 is pivoted about the hinge shaft 31 in a direction of pressing a contact surface 65 of each of the knobs 60 (see FIG. 6).

At this time, as the return member 80 presses at least one knob 60 that has not been pressed downward, the knob is moved downward along a relevant one of the guide holes 21. Thus, a lower unlocking portion 63 of the newly pressed knob 60 is brought into contact with an upper unlocking portion 62 of a knob 60 that has been already lowered, while applying a force thereto in a direction approximately perpendicular to the vertically advancing direction of the knob 60 (see FIG. 9).

A top locking protrusion 61 of the knob 60 that has been already lowered is released from locking steps 22 of a relevant one of the guide holes 21, so that the knob 60 together with a pen core 50 corresponding thereto are returned to the state before use thereof by an elastic force of a relevant return spring 70, whereby a nib of the pen core is accommodated in the lower housing 10 through the nib passing through-hole 11.

Therefore, when the clip member 30 is moved, all the knobs 60 and pen cores 50 can be automatically returned to their initial states before use thereof, thereby preventing occurrence of cases where the nibs of the pen cores may be damaged or clothes may be stained by inks due to contact of the nibs with the clothes for a long period of time.

Figure 8:
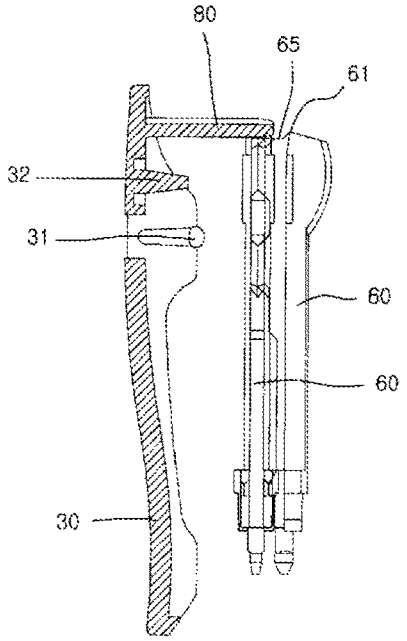
FIG. 8 is a view illustrating installation positions of the knobs and a return member provided in the clip member.
Figure 10:
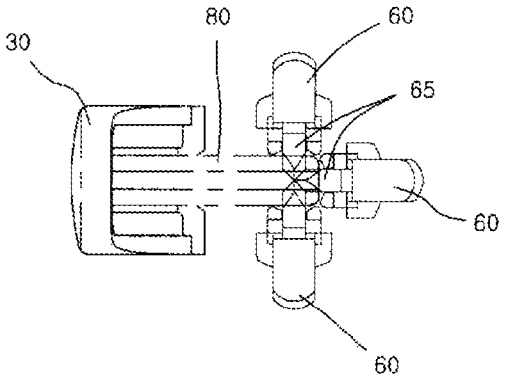
FIG. 10 is a plan view of FIG. 8.
Figure 11:
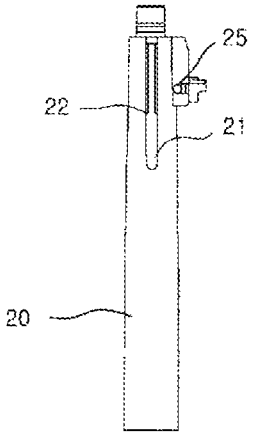
FIG. 11 is a side view of an upper housing of the multicolor writing instrument according to the present invention.
Figure 12:
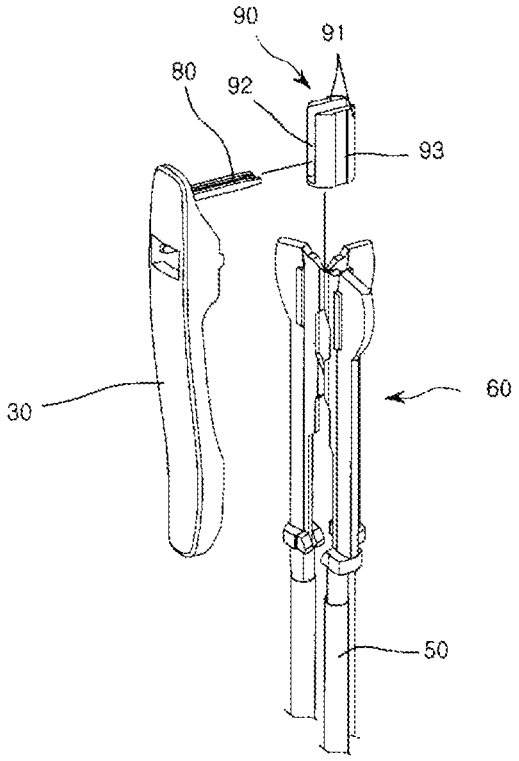
FIG. 12 is an exploded perspective view showing a state where an auxiliary member is assembled between a return member and knobs in a preferred embodiment of the present invention.

At this time, a distal end of the return member 80 is placed on the contact surface 65 formed between the top locking protrusion 61 and the upper unlocking portion 62 of each of the knobs 60 (see FIGS. 8 and 10).

Meanwhile, an auxiliary member 90 is further provided between the return member 80 and the knobs 60 so as to simultaneously press the knobs 60 when the return member 80 is pivoted in an upper internal space of the upper housing 20 (see FIGS. 12 to 16).

The auxiliary member 90 has a guide groove 92 formed between posts 91 so that the auxiliary member 90 may be operated with the return member 80 fitted into the guide groove 92. Both outer surfaces of the posts 91 are formed with guide channels 93 such that guide protrusions formed on an inner surface of the upper housing 20 are fitted into the guide channels 23 so as to guide a vertical movement of the auxiliary member 90.

Figure 13:
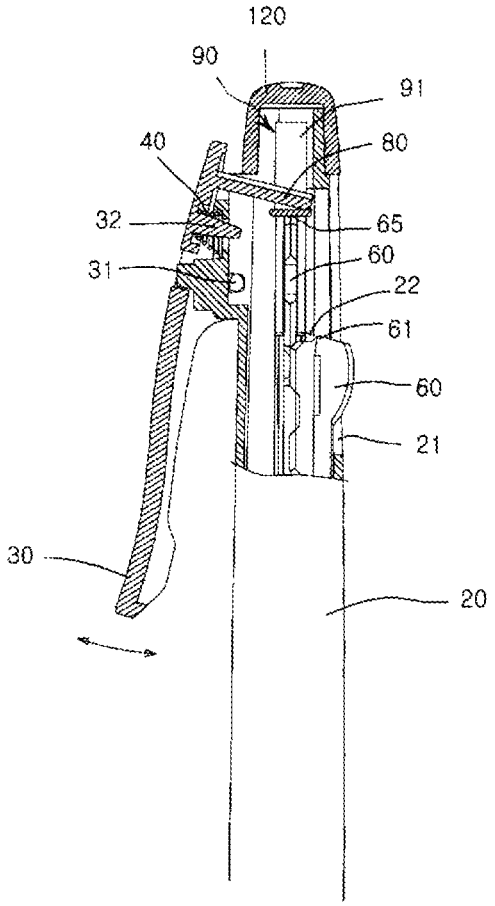
FIG. 13 is a partially enlarged sectional view showing an assembled state of main portions in the preferred embodiment of the present invention.

Accordingly, when the lower end of the clip member 30 is intentionally spread spread during the process of putting the writing instrument on a pocket of clothes by the user, the return member 80 is pivoted through the auxiliary member 90 in the direction of pressing the contact surface 65 of each of the knobs 60 (see FIG. 13).

Figure 14:
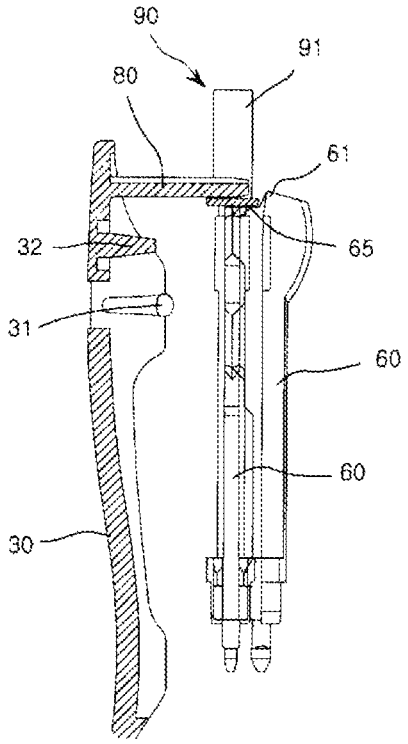
FIG. 14 is a view illustrating an installed state of a clip member, the auxiliary member and the knobs in the preferred embodiment of the present invention.
Figure 15:
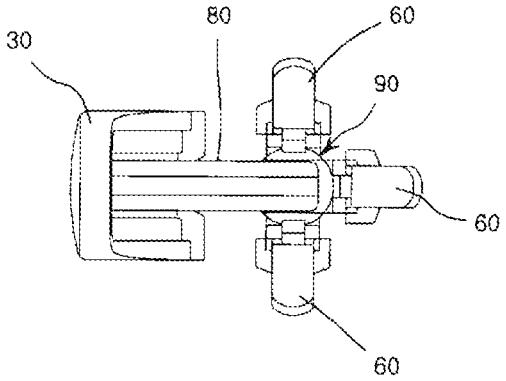
FIG. 15 is a plan view of FIG. 14.
Figure 16:
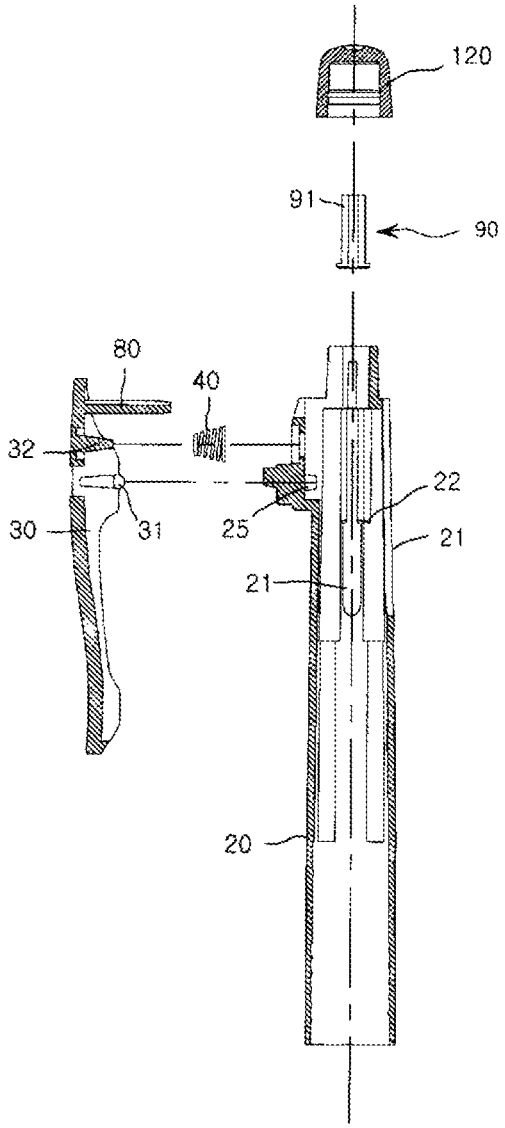
FIG. 16 is an exploded sectional view showing the main portions in the preferred embodiment of the present invention.

A diameter of a lower end of the auxiliary member 90 is designed such that the lower end can be brought into contact with the contact surface 65 formed between the upper locking protrusion 61 and the upper unlocking portion 62 of each of the knobs 60 (see FIG. 14).

Therefore, when the clip member 30 is moved, the return member 80 cooperates with the auxiliary member 90 so that all the knobs 60 and pen cores 50 can be automatically returned to their initial states before use thereof, thereby preventing occurrence of cases where the nibs of the pen cores may be damaged or clothes may be stained by inks due to contact of the nibs with the clothes for a long period of time.

Although the operation of the clip member 30 causes the return member 80 to be pivoted and to press all the knobs 60 even when none of the pen cores 50 is lowered to cause a nib thereof to be exposed to the outside through the nib passing through-hole 11, the state where all the pen cores 50 have been already returned is maintained.

The return member 80 preferably has protruding ribs formed integrally therewith at both sides of an upper surface of the return member in a longitudinal direction of the return member so as to reinforce the strength of the return member.

The cap 120 serves to prevent the auxiliary member 90 from escaping to the outside of the upper housing 20 when the auxiliary member 90 is returned by the elastic force of the return spring 70 and to maintain the state where the auxiliary member 90 is stably accommodated in the upper housing 20.

Although the multicolor writing instrument having the configuration in which the three pen cores 50 and the relevant knobs 60 are operated is illustrated by way of example in the figures for the sake of convenience, it should be noted that multicolor writing instruments for two to five colors may also be implemented.

With such a locking mechanism according to the present invention, the configuration of the multicolor writing instrument is relatively simplified to lower manufacturing costs, and concern about a failure is reduced, thereby further extending the service life of the product and improving the reliability of the product.

According to the present invention, when the multicolor writing instrument is put on clothes, the nibs of all the pen cores are automatically returned to the interior of the housing so that the nibs of the pen cores are not exposed to the outside. Therefore, it is possible to prevent occurrence of cases where the nibs of the pen cores are damaged or the clothes are stained by inks.

Further, since the number of parts and the assembling process of the multicolor writing instrument according to the present invention are the same as those of a conventional one, the present invention can considerably improve the convenience and marketability of the product without increasing manufacturing costs.

It will be apparent to those skilled in the art that the present invention described above is not limited to the aforementioned embodiments and the drawings, but various substitutions, changes and alterations can be made thereto without departing from the spirit and scope of the invention.

(Explanations of Reference numerals)

| | |
|---|---|
| 10: lower housing | 11: nib passing through-hole |
| 20: upper housing | 21: guide hole |
| 22: locking step | 30: clip member |

-continued (Explanations of Reference numerals)

| | |
|---|---|
| 31: hinge shaft | 40: coil spring |
| 50: pen core | 60: knob |
| 61: top locking protrusion | 62, 63: unlocking portion |
| 65: contact surface | 70: return spring |
| 80: return member | 90: auxiliary member |
| 91: post | 92: guide groove |

What is claimed is:

1. A multicolor writing instrument with an automatic return function, comprising:

a lower housing (10) having a hollow cylindrical shape and having a nib passing through-hole (11) formed therethrough at a tip of the lower housing;

an upper housing (20) connected to an upper portion of the lower housing (10) and having guide holes (21) and locking steps (22) formed respectively inside the guide holes;

a clip member (30) hingedly provided on the upper housing (20) so as to be movable about a hinge shaft (31);

a coil spring (40) resiliently installed between the clip member (30) and the upper housing (20);

pen cores (50) accommodated in the upper housing (20) and the lower housing (10) and filled with at least two different color inks;

knobs (60) installed to be slidably moved under guidance of the guide holes (21) and having ends fitted into the respective pen cores (50), each of the knobs having a top locking protrusion (61) caught by the locking steps (22) and two unlocking portions (62, 63);

return springs (70) resiliently installed between the pen cores (50) and the knobs (60); and a return member (80) formed integrally with the clip member (30) on one side of the hinge shaft (31) and toward the respective knobs (60) so that when a lower end of the clip member (30) is pivoted, the return member (80) returns the respective knobs (60) and pen cores (50), wherein an auxiliary member (90) is further provided between the return member (80) and the knobs (60) so as to simultaneously press the knobs (60) when the return member (80) is pivoted in an upper space of the upper housing (20), and wherein the auxiliary member (90) has a guide groove (92) formed between posts (91) so that the auxiliary member may be operated with the return member (80) fitted into the guide groove, and the posts (91) are formed with guide channels (93) to guide a vertical movement of the auxiliary member within the upper housing (20).

* * * * *